United States Patent [19]

Yamasaki

[11] Patent Number: 4,899,403

[45] Date of Patent: Feb. 13, 1990

[54] APPARATUS FOR CONTROLLING EXPANSION OR CONTRACTION OF COVER CLOTH WITH RESPECT TO BED BASE

[75] Inventor: Yoshikiyo Yamasaki, Osaka, Japan

[73] Assignees: Kabushiki Kaisha Fuji Iryoki; Kabushiki Kaisha Japan Health, both of Osaka, Japan

[21] Appl. No.: 319,219

[22] Filed: Mar. 3, 1989

[51] Int. Cl.[4] ..... A61G 7/00; A61H 7/00

[52] U.S. Cl. ..... 5/60; 5/211; 5/216; 5/184; 128/52; 128/33

[58] Field of Search ..... 5/1, 211, 212, 216, 5/181, 184, 187, 482, 60; 128/53, 52, 51, 33, 70

[56] References Cited

U.S. PATENT DOCUMENTS

| | | | |
|---|---|---|---|
| 611,270 | 9/1898 | Nilson | 5/216 |
| 977,671 | 12/1910 | Melander | 5/211 |
| 1,518,386 | 12/1924 | Brower | 5/211 |
| 1,528,129 | 3/1925 | Phillips | 5/187 |
| 1,691,268 | 11/1928 | Conrad | 5/211 |
| 2,204,624 | 6/1940 | Rupp | 128/33 |
| 3,646,623 | 3/1972 | Harris | 5/181 |
| 4,190,043 | 2/1980 | Thompson | 128/52 |
| 4,412,534 | 11/1983 | Hamabe | 128/52 |
| 4,656,998 | 4/1987 | Masuda et al. . | |
| 4,662,362 | 5/1987 | Masuda et al. . | |

FOREIGN PATENT DOCUMENTS

| | | | |
|---|---|---|---|
| 67698 | 9/1948 | Denmark | 5/181 |
| 3026941 | 2/1982 | Fed. Rep. of Germany | 128/52 |
| 56-95049 | 8/1981 | Japan . | |
| 57-17655 | 1/1982 | Japan . | |
| 59-189851 | 10/1984 | Japan . | |
| 61-90664 | 5/1986 | Japan . | |

*Primary Examiner*—Gary L. Smith
*Assistant Examiner*—F. Saether
*Attorney, Agent, or Firm*—Flynn, Thiel, Boutell & Tanis

[57] ABSTRACT

A bed base having first and second members which are of generally U-shaped configuration so as to slidably telescope together to permit expansion or contraction of the bed base in the lengthwise direction. Locking mechanisms coact between the telescoping legs to lock the bed base in the selected expanded or contracted position. A sheetlike cover is anchored at one end of the bed base and extends along the upper surface thereof towards the other end, at which point an intermediate part of the cover wraps downwardly around a guide drum and then projects reversely toward the other end of the bed base. The lower free end edge of the cover is connected to a compensating mechanism which adjusts the cover length, namely by moving the cover upwardly or downwardly around the guide drum, so that the upper section of the cover always stretches tautly across the upper surface of the bed base irrespective of the adjusted expanded or contracted position.

8 Claims, 5 Drawing Sheets

APPARATUS FOR CONTROLLING EXPANSION OR CONTRACTION OF COVER CLOTH WITH RESPECT TO BED BASE

FIELD OF THE INVENTION

This invention relates to the apparatus for controlling expansion or contraction of a cover cloth with respect to a bed base to change the length, which makes it possible to massage the whole human body when lying in a supine condition, and which makes it possible to constantly maintain the cover cloth tight in proportion to expansion or contraction of the bed base.

BACKGROUND OF THE INVENTION

The bed-type massaging apparatus is generally equipped in the interior of the bed base with massaging rollers which drive and run due to a driving apparatus, and is made such that the massaging rollers move and run on guide rails arranged on both sides of the interior of the bed base. The bed-type apparatus makes it possible to massage the back part of the human body with a finger-pressure or a sliding movement, provided that the massaging rollers as they rotate slide along the back of the human body when lying supine on the bed-type massaging apparatus. In recent years, the apparatus can preferably be changed to the compact size for the purpose of taking up less space at the time of transport or storage.

For example, a bed-type massaging apparatus is known in which foldable guide rails are arranged on both sides of the interior of the bed base; the bed frame itself can be folded with an elastic body; and the massaging rollers are made so as to move and run on the guide rails. This known apparatus was intended to occupy less space during transport or storage by making the bed base two-folded or three-fold when not in use.

However, in this known bed-type massaging apparatus, the expansion or the contraction of the bed base is merely so that it is possible to fold for the purpose of transporting and storing, and although the breadth of the bed base can be contracted in the transverse direction, it is impossible to decrease the overall volume. Consequently, problems associated with packing etc. still exist.

Furthermore, since the known bed-type massaging apparatus has the object of contracting the breadth for transport and storage, it is not possible to control the expansion or contraction in proportion to the stature of the user. Accordingly, in the case where a user of shorter stature than the length of the bed base uses it and massages the body, the rollers for massaging move over a range in excess of the user's stature, namely on parts of the user's stature in excess of the necessary range to generate optimum massaging, thereby wasting electric power and time.

Then, the applicant of the present invention discovered that, as a means to overcome the above-mentioned problems, the bed base of the bed-type massaging apparatus can be oppositely expanded or contracted in the lengthwise direction without folding. But, in this case, there have been problems concerning the means for expanding or contracting the cover cloth covering the surface of the bed base in order to make the cover cloth movement applicable to the bed base movement.

The object of the invention is to provide an apparatus for controlling expansion or contraction of the cover cloth with respect to the bed base so that it is possible to change the length, in which the bed base and the cover cloth expand or contract in associated relation, and besides which it is possible to constantly maintain the cover cloth in a tightened condition in an optional position of expansion or contraction, so as to overcome the above-mentioned problems.

SUMMARY OF THE INVENTION

This invention relates to an apparatus for controlling expansion or contraction of a cover cloth with respect to a bed base so that it is possible to change the length. The bed base can be oppositely expanded or contracted in the longer or lengthwise direction due to the legs of a second flat bed base member being slidably telescoped into the legs of a first flat bed base member. The cover cloth has one end fixed adjacent on outer end of the second bed base member, and an intermediate portion of the cover is wound around a revolving drum mounted at the outer end of the first bed base member so as to cover all the upper surface of the bed base. A mechanism for controlling expansion or contraction of the cover cloth length is connected to the other end of the cover adjacent the underside of the bed frame. This mechanism includes wires connected to both sides of the other end of the cover cloth, which wires reversely pass around first revolvable rollers arranged on the inner end of the first bed base member, and then reversely pass around second revolvable rollers arranged on the inner end of the second bed base member, and then are anchored adjacent the outer end of the second bed base member.

In addition, a releasable locking mechanism coacts with plural stopping holes disposed at lengthwise intervals along the legs of the second bed base member of the bed base. The locking mechanism includes lock pins which can be fitted into associative stopping holes.

To take advantage of the apparatus for controlling expansion or contraction of the cover cloth with respect to the bed base to change the length, the first bed base member is pushed in the direction toward the second bed base member. The bed base is contracted by the pushed in distance and, because the wire and the cover cloth have constantly defined lengths, it results that: the first revolvable rollers are pushed inwardly in the same direction as the first bed base member due to contraction of the bed base, the cover cloth adjacent the bottom of the bed base is pulled in by the pushed in distance of the wire between the first and the second revolvable rollers, and the upper surface of the cover shortens by the same distance as the cover passes around the revolving drum; whereby the cover cloth on the upper surface of the bed base is contracted by the same length as the contracted distance of the bed base.

The bed base and cloth cover are expanded by a reverse operation.

Accordingly, the apparatus for controlling expansion or contraction of the cover cloth with respect to the bed base makes it possible to change the bed length, is able to constantly and associatively make the bed base and the cover cloth simultaneously expand or contract, and is able to constantly maintain the cover cloth in a taut condition in whatever selected expanded or contracted position.

The apparatus for controlling expansion or contraction of the cover cloth with respect to the bed base also has a locking mechanism with plural associative stopping holes at intervals of definite distance and cooperating lock pins for fixing the bed base in the selected position of expansion or contraction.

DETAILED DESCRIPTION

Figure 1:
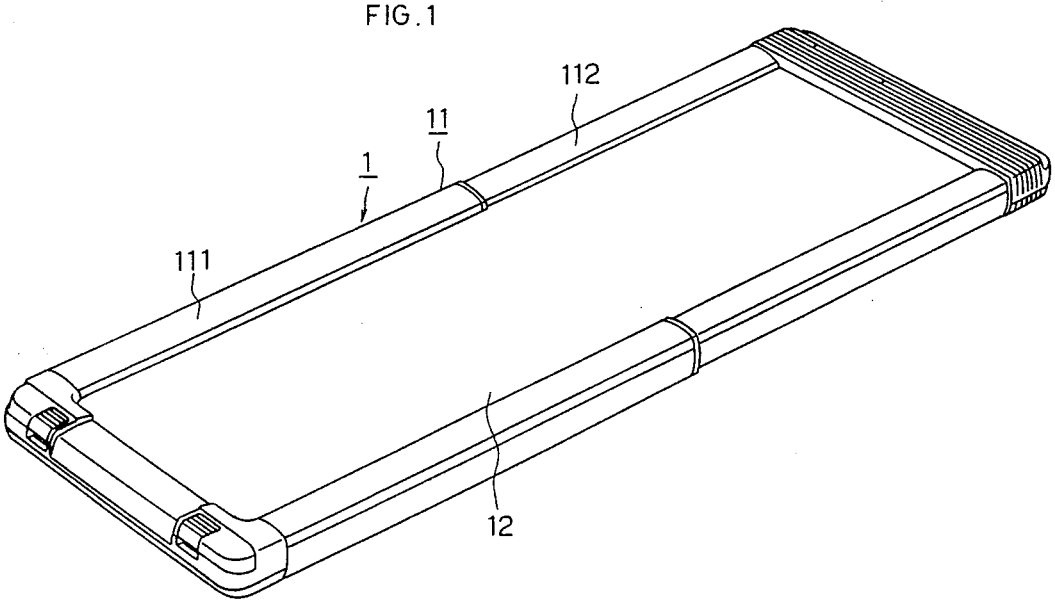
FIG. 1 is a perspective view which shows an embodiment of the apparatus for controlling expansion or contraction of a cover cloth with respect to a bed base possible to change the length.

FIG. 1 shows an embodiment of a bed-type massaging device having an apparatus for controlling expansion or contraction of a cover cloth with respect to a bed base so that it is possible to change the length. The bed-type massaging device includes the apparatus 1 for controlling expansion or contraction of the cover cloth with respect to the bed base to change the length and a massaging apparatus 2.

Figure 2:
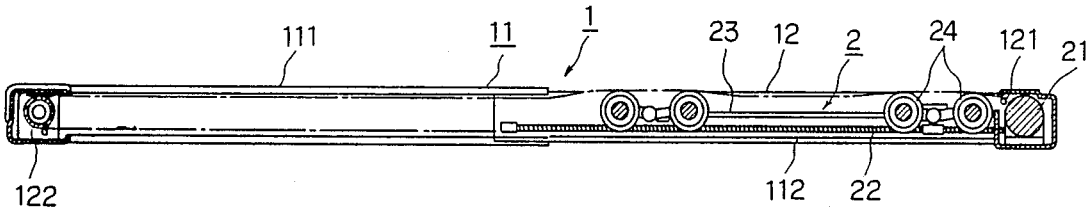
FIG. 2 is a longitudinal sectional view of the apparatus of FIG. 1.
Figure 3:
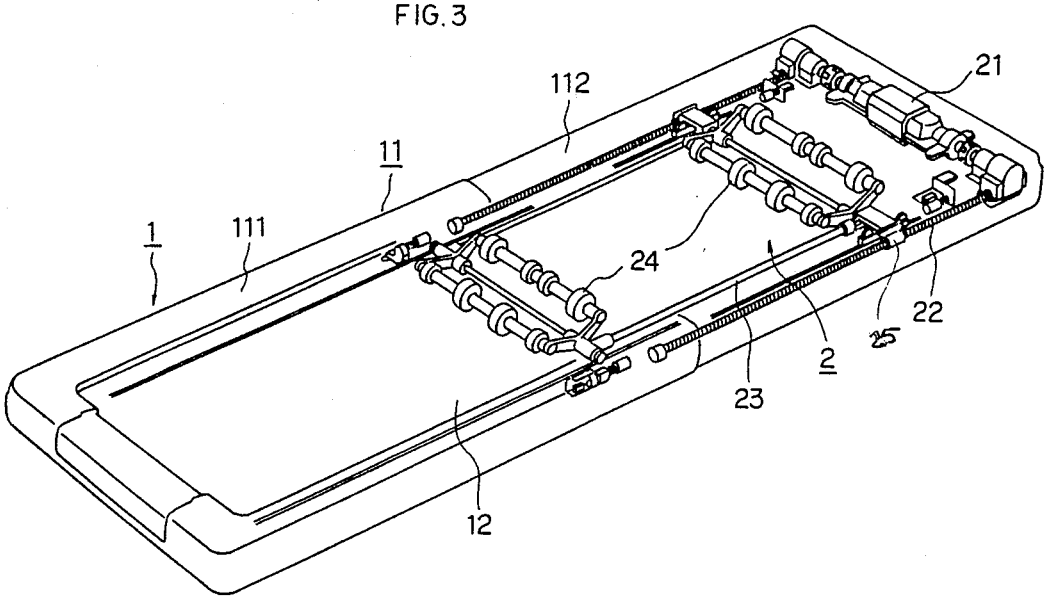
FIG. 3 is an explanatory perspective view which shows a massaging arrangement as utilized in the apparatus.
Figure 4:
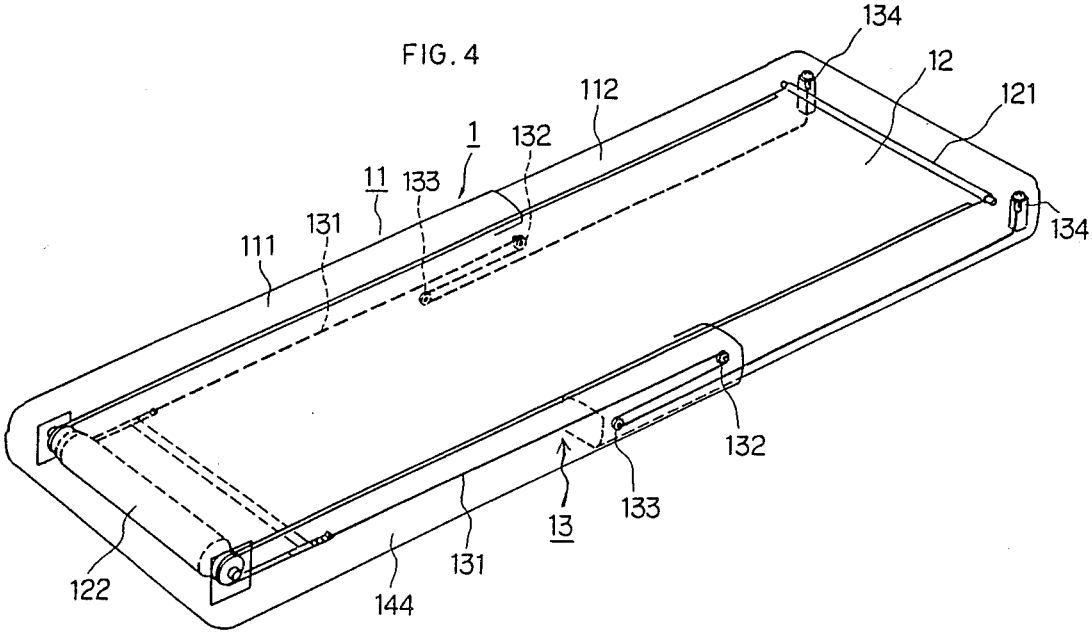
FIG. 4 is an explanatory perspective view which shows an embodiment of the mechanism for controlling expansion or contraction of the cover cloth length.

The apparatus 1 comprises, as shown in FIG. 2, a bed base 11 which is possible to be expanded or contracted in the lengthwise direction, a cover cloth 12 which is wound so as to cover all the upper surface of the bed base 11, and a mechanism 13 for controlling expansion or contraction of the cover cloth length which, as shown in FIG. 4, controls expansion or contraction of the cover cloth 12 corresponding to expansion or contraction of the bed base 11.

The massaging apparatus 2 comprises a driving motor mechanism 21 which is mounted on one end of the bed base 11, a pair of rotatable screw shafts 22 drivingly connected with opposite ends of the mechanism 21, and a massaging body 23 which includes massaging roller groups 24 and which has nut portions 25 engaged with the screw shafts 22.

The bed base 11, as shown in FIG. 2 and FIG. 4, comprises a flat first U-shaped bed base member 111 having a length about one-half that of the bed base 11, and a second U-shaped bed base member 112 which has the legs thereof telescopically inserted into the legs of the first bed base member 111, and which bed base member 112 is approximately the same length and the same shape as the first bed base ember 111. The bed base 11 can thus be expanded or contracted in the longer (i.e. length-wise) direction (provided that the longest distance of contraction is approximately one-half the length of the bed base 11 when fully expanded).

The cover cloth 12 is constantly tightly wound so as to cover all the upper surface, and thus bears no relation to the condition of expansion or contraction of the bed base 11, as shown in FIG. 1. To maintain this tightly wound condition, the cover cloth 12 is controlled as shown in FIG. 4. A support shaft 121 is mounted adjacent the bight part which defines the outer end of the second bed base member 112. One end of the cover cloth 12 is fixed to the shaft 121, as by an adhesive. A rotatable drum 122 is mounted adjacent the outer end of the first bed base member 111. The cover cloth 12 Wraps around the drum 122 about one-half revolution and projects outwardly so that the other end of the cover connects to the mechanism 13 for controlling expansion or contraction of the bed cloth length. Consequently, a tightened condition of the cover cloth 12 is constantly maintained.

Figure 7:
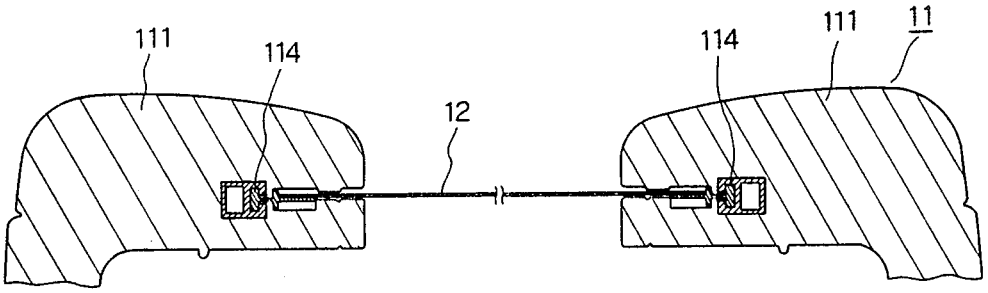
FIG. 7 is an explanatory view showing the tightening condition of the cover cloth.

Furthermore, in order to smooth the cover movement when expanded or contracted, the cover cloth 12 has, as shown in FIG. 7, edge parts 114 slidably disposed in guide grooves formed in the inner surfaces of the side legs of the bed base 11. Both side edges of the cover cloth are held in guide grooves to facilitate sliding.

Figure 8:
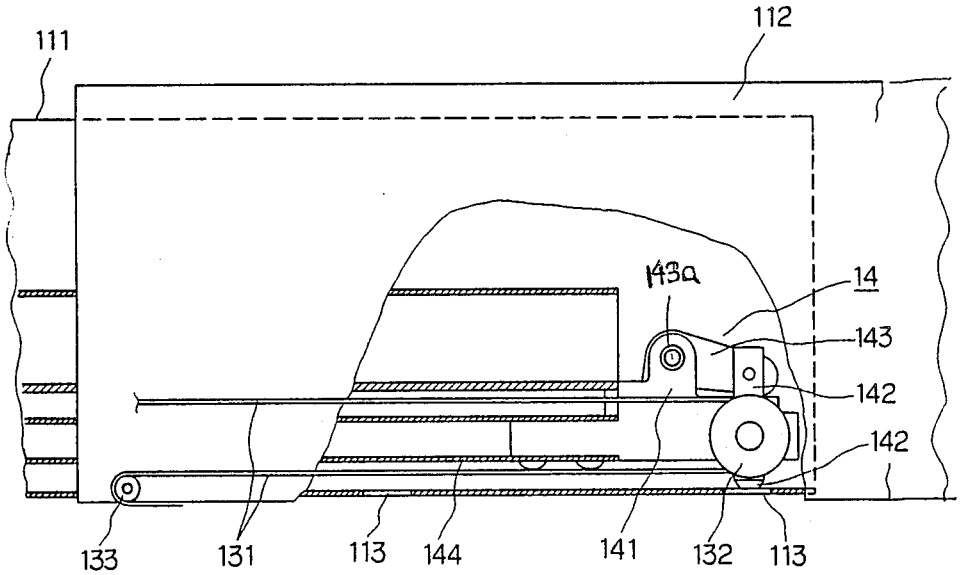
FIG. 8 is a partial fragmentary view which shows the mechanism for controlling expansion or contraction of the cover cloth length and the locking mechanism.

The mechanism 13 for controlling expansion or contraction of the cover cloth length, as shown in FIG. 4 and FIG. 8, comprises: wires or elongate flexible elements 131 disposed within the bed base side legs and connected to one end edge of cover cloth 12 adjacent opposite sides thereof, first revolvable rollers 132 supported adjacent the free ends of the legs of the first bed base member 111, second revolvable rollers 133 mounted adjacent the free ends of the legs of the second bed member 112, and wire fixing members 134 which fixed the other ends of the wires 131 to the outer end of the second bed base member 112. Each wire 131 is connected to the other end edge of the cover cloth 12, is then wrapped around the first revolvable roller 132 and extends reversely, is then wrapped around the second revolvable roller 133 and extends reversely, and is then anchored to the wire fixing member 134.

Figure 5:
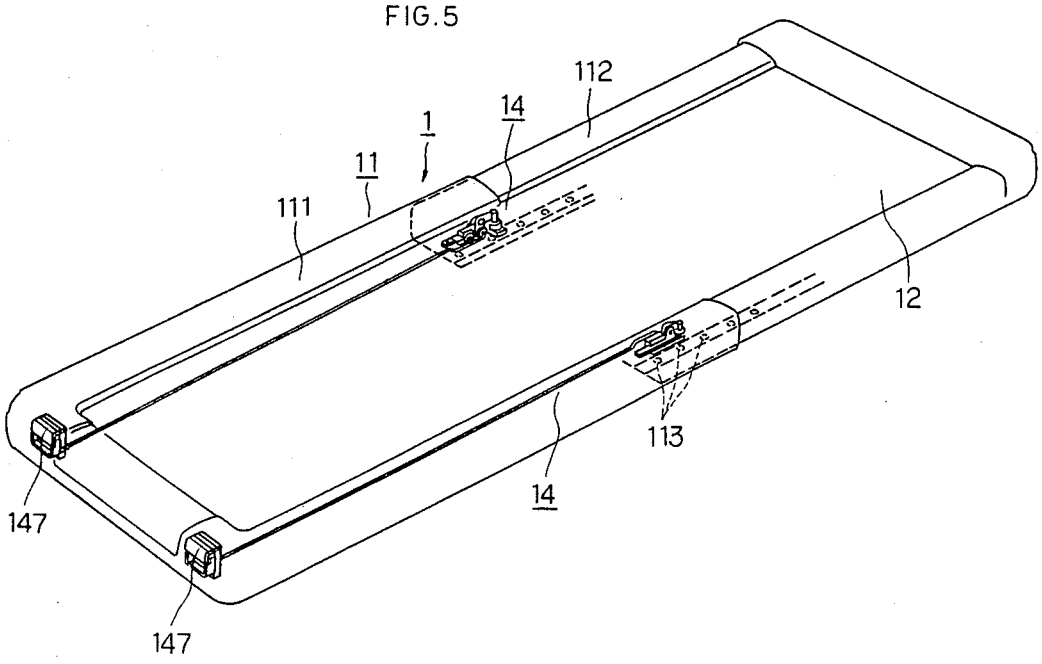
FIG. 5 is an explanatory perspective view which shows an embodiment of the locking mechanism.
Figure 6:
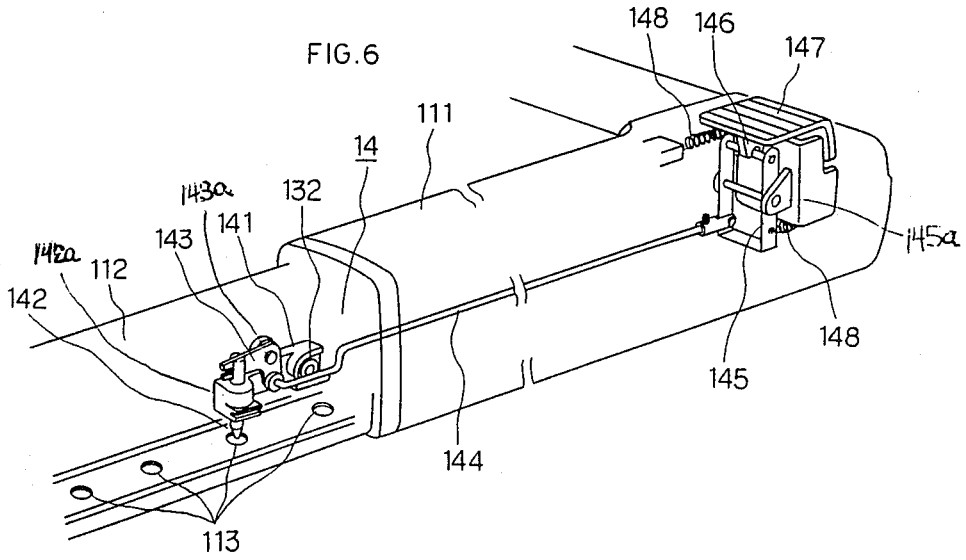
FIG. 6 is an enlarged fragmentary view showing the locking mechanism.

FIG. 5 and FIG. 6 illustrate an embodiment of a locking mechanism 14 for locking the bed base 11 at selected intervals when adjusting expansion or contraction. The locking mechanism 14 is arranged, within each pair of telescoping legs of the bed base members 111 and 112. The locking mechanism 14 comprises: a lock pin 142 which can be fitted in a plurality of stopping holes 113 formed at intervals of definite distance through the lower wall of the legs of the second bed base member 112; a support member 141 which is stationarily mounted on the leg of base member 111 adjacent the free end thereof; an L-shaped control lever 143 which is supported on the support member 141 by a pivot 143*a*, and which has one end of one lever arm pivotally connected to the upper end of the lock pin 142 to control the vertical sliding of pin 142; a support hub 142*a* which is stationarily mounted adjacent the free end of the leg of base member 111 for vertically slidably supporting the pin 142; an elongated rod 144 whose one end is pivotally connected to the end of the other arm of lever 143, which rod 144 extends through the leg of member 111; a frame member 145 whose lower part is pivotally connected with the other end of rod 144 for pushing or pulling the rod 144, and whose middle part is fixed to the base member 111 by a pivot 145*a;* and a pushing or pulling plate 146 pivotally joined to the upper end of frame member 145, which plate 146 is fixed to an actuator member 147 which is manually accessible adjacent the corner of the first bed base member 111. The frame member 145 and the actuator plate 147 are made so as to return to an original position by the force of a spring 148 so as to normally maintain the pin 142 within one of the holes 113.

Still further, to make the structure as compact in size as possible, the first revolvable roller 132 is supported on the support member 141.

OPERATION

Figure 9:
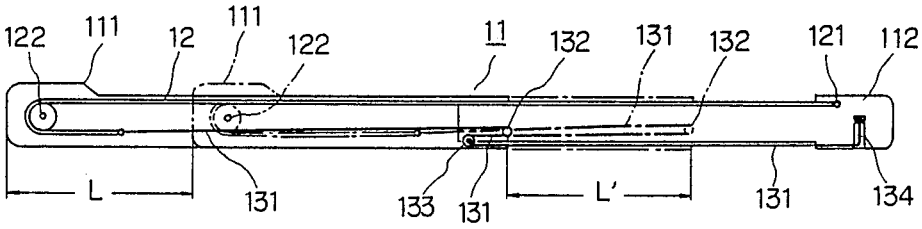
FIGS. 9 and 10 are explanatory views which illustrate different expanded and contracted positions.

In case the bed base is to be contracted, then bed base member 111 is pushed inwardly a distance L in the direction of the second bed base member 112 as shown in FIG. 9. Since the wires 131 and the cover cloth 12 have constant definite lengths, the above operation results in the revolvable roller 132 also being pushed in the same direction as the first bed base member 111 simultaneously with the contraction of the bed base 11; the cover cloth 12 is pulled in from the upper surface of the bed base 11 and then downwardly around the revolving drum 122 by the pushed in distance L' of the wire 131 as defined between the first roller 132 and the second roller 133; and the cover cloth 12 on the upper surface of the bed base 11 is contracted by the same distance L' as the contracted distance L of the bed base 11.

Reversely, in case the first bed base member 111 is pulled away from the second bed base member 112 to return the bed base 11 to its original length, the bed base 11 is expanded by the returned distance L. By expanding the bed base 11, the first revolvable roller 132 is also returned in the same direction as the movement of the first bed base member 111; the cover cloth 12 is removed from the bottom of the bed base 11 around he drum 122 to the upper surface by the returned distance L' of the wire 131 between the rollers 132 and 133; and the cover cloth 12 on the upper surface of the bed base 11 is expanded by the same distance as the expanded length of the bed base 11 (L=L').

Accordingly, the apparatus for controlling expansion or contraction of the cover cloth with respect to the bed base makes it possible to change the length of the bed base 11 and simultaneously expand or contract the associated cover cloth 12, and besides the cover cloth 12 is constantly maintained in a tightened or taut condition in whatever position of expansion or contraction selected for the bed base 11.

Figure 10:
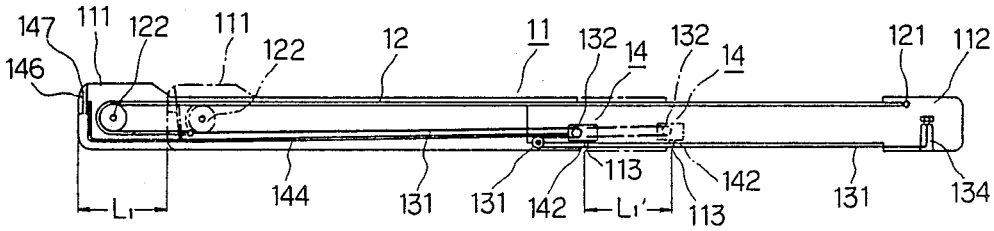

To operate the locking mechanism 14 for permitting expansion or contraction, as shown in FIG. 10, the mechanism 14 operates by the steps of: pulling the actuator plates 147 outwardly on both sides of the bed base 11; this pushes rods 144 inwardly so that levers 143 rock and lift pins 142 upwardly to release them from holes 113; then pushing the first bed base member 111 a desired distance inwardly (which is limited to the locations of the stopping holes 113) into the second bed base member 112; and the bed base 11 is thus contracted by the pushed in distanced $L_1$. Then, the actuator plates 147 are released and the springs return the mechanism to its original position so that the lock pins 142 are inserted into appropriate holes 113.

With this invention, it is possible to reduce by about one-half the length and volume of the bed base when collapsed, and thus make it possible to greatly reduce the costs for conveyance and packing, and making it possible to make the design of the external appearance beautiful when in the collapsed condition.

Furthermore, by forming plural stopping holes at spaced intervals along the legs of the second bed base member, and arranging the locking pins for selective engagement therewith, it is possible to minutely control expansion or contraction in proportion to the stature of an user, which has been impossible in the conventional bed-type massaging apparatus. In case that a user, whose stature is shorter than the length of the bed base, uses this apparatus, it is possible to use this either as a bed or as a massaging bed on the condition that we use it only be controlling the length of the bed base to adapt it to the user. Especially in case that we use the apparatus as an exclusive massaging bed, waste in electric power and time is not generated, which is due to the massaging movement of the roller being adjusted to the required extent of the user's stature.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. An apparatus for controlling expansion or contraction of a cover cloth with respect to a bed base to change the length thereof, comprising:

a length-adjustable bed base having a flat second bed base part which is inserted into a flat first bed base part to permit expansion or contraction of the bed base in the lengthwise direction thereof;

a sheetlike cover cloth of which one end is fixed adjacent an outer end of said second bed base part, and which is partially wrapped around a revolving drum mounted adjacent the outer end of said first bed base part so as to cover the upper surface of the bed base; and a mechanism for controlling expansion or contraction of the length of the cloth cover in response to expansion or contraction of the bed base, which mechanism includes a pair of wires each connected at one end to an opposite side of the cloth cover at the other end of the cloth cover, which wires reversely partially wrap around first revolvable rollers mounted adjacent an inner end of the first bed base part and which further reversely partially wrap around second revolvable rollers mounted adjacent an inner end of the second bed base part and which have the other ends thereof fixed to said second bed base part adjacent the outer end thereof.

2. An apparatus according to claim 1, including a plurality of stopping holes in a lower surface of the second bed base part at predetermined intervals, and a lock mechanism mounted on the first bed base part for controlling a movable lock pin which is associatively fitted into a selected one of the associative stopping holes.

3. In a massaging-type bed provided with a bed base, a flexible sheetlike cover positioned so as to extend over an upper surface of the bed base, and a movable roller assembly mounted on the bed base below the cover to permit massaging of a body positioned on the cover, the improvement comprising:

said bed base including first and second generally U-shaped bed base members each including a bight part and a pair of leg parts which project generally perpendicularly from opposite ends of the respective bight part in generally parallel relationship to another, the leg parts of one bed base member being slidably telescoped generally into the leg parts of the other bed base member so as to permit the lengthwise dimension of the bed base to be selectively extended to contracted;

locking means coacting between said first and second bed base members for permitting the bed base members to be selectively fixedly locked together in a selected one of a plurality of lengthwise positions to permit selective expansion or contraction in the length of the bed base;

a guiding member mounted on said bed base adjacent the bight part of said first bed base member and extending transversely thereacross, said sheetlike cover having one end edge disposed adjacent and fixedly anchored relative to the bight part of said second bed base member, said cover having an upper portion which extends transversely across the bed base and which extends from said one end edge to a point of engagement with said guiding member, said cover having an intermediate portion which wraps downwardly around said guiding member and joins to a lower portion which is disposed downwardly from the upper portion and projects away from the guiding member in a direction toward the bight part of said second bed base member, said lower portion terminating in another end edge; and a compensating mechanism coacting between said bed base and said another end edge of said cover for maintaining the upper portion of said cover in a taut condition while still fully covering the upper surface of said bed base when said bed base is expanded or contracted.

4. A bed according to claim 3, wherein said compensating mechanism includes an elongate flexible cable having one end thereof anchored to said cloth adjacent said another end edge thereof and the other end thereof anchored to said second bed base member adjacent the bight part thereof, said compensating mechanism also including first and second guides mounted on the respective first and second bed base members and disposed in engagement with and having said cable wrapped partially therearound at locations spaced inwardly from the ends of said cable.

5. A bed according to claim 4, wherein said first and second guides respectively comprise first and second rotatable pulleys, said first pulley being mounted on said first bed base member adjacent the free end of the respective leg part, and said second pulley being mounted on the second bed base member adjacent the free end of the respective leg part, said cable extending from said one end thereof to said first pulley and thence being wrapped therearound and extending to said second pulley and thence being wrapped therearound and extending to the other end thereof.

6. A bed according to claim 5, wherein said compensating mechanism includes two said cables each cooperating with first and second pulleys, said cables and cooperating pulleys being disposed adjacent opposite sides of the bed base within the telescopic leg parts.

7. A bed according to claim 3, wherein said roller assembly includes motor means mounted on said second bed base member adjacent the bight part thereof and a drive mechanism extending therefrom along the leg parts of said second bed base member for driving a roller mechanism in the lengthwise direction of the bed base.

8. A bed according to claim 7, wherein said locking mechanism includes a series of lock-receiving openings formed in each of the leg parts of said second bed base member, a locking pin movably supported within each of the leg parts of said first bed member and adapted for removable insertion into a selected one of said openings, and an actuator mechanism extending from said locking pin lengthwise along each of the leg parts of said first bed base member so as to terminate in a manually-accessible actuator disposed adjacent an end of the bight part of the respective first bed base member.

* * * * *

UNITED STATES PATENT AND TRADEMARK OFFICE

CERTIFICATE OF CORRECTION

PATENT NO. : 4 899 403

DATED : February 13, 1990

INVENTOR(S) : Yoshikiyo YAMASAKI

It is certified that error appears in the above-identified patent and that said Letters Patent is hereby corrected as shown below:

Column 7, line 5; change "to" to ---or---.

Column 8, line 30; change "mechanism" to ---means---.

Column 8, line 33; after "bed" insert ---base---.

Signed and Sealed this

Twelfth Day of November, 1991

*Attest:*

HARRY F. MANBECK, JR.

*Attesting Officer*

*Commissioner of Patents and Trademarks*